United States Patent [19]

Clark

[11] Patent Number: 4,664,447

[45] Date of Patent: May 12, 1987

[54] APPARATUS FOR REMOVING ROOFING MATERIAL

[76] Inventor: Harry I. Clark, 3908 Old Brownsboro Hill Rd., Louisville, Ky. 40222

[21] Appl. No.: 825,631

[22] Filed: Feb. 3, 1986

[51] Int. Cl.[4] ..... E21C 47/00

[52] U.S. Cl. ..... 299/39; 144/115; 144/117 R; 144/117 C; 144/218; 51/176

[58] Field of Search ..... 299/36, 39; 51/176; 144/2 R, 49, 115, 117 C, 119 R, 119 A, 118, 231, 237, 117 R

[56] References Cited

U.S. PATENT DOCUMENTS

| | | | |
|---|---|---|---|
| 2,174,782 | 10/1939 | Erickson | 144/208 G |
| 2,454,650 | 11/1948 | Harris | 51/176 |
| 3,829,161 | 8/1974 | Wirtgen | 299/39 |
| 4,340,256 | 7/1982 | Hart | 299/39 |
| 4,523,361 | 6/1985 | Dummermuth | 51/176 |

*Primary Examiner*—W. D. Bray
*Attorney, Agent, or Firm*—Charles G. Lamb

[57] ABSTRACT

An apparatus for removing roofing material from a roof includes a framework with driven roof contact rollers and support wheels attached thereto so that the apparatus will roll on the roof. The apparatus further includes driven roof material cutters drum attached to the framework for cutting or shredding the roofing material as the apparatus moves over the roof on the driven rollers and wheels. The apparatus has a vacuum device for conveying the cut or shredded roofing material away from the roof material cutter drum for disposal. A suspension system interconnects the driven roof contact rollers and wheels so that the cutter drum will follow the contours of the roof over which the apparatus is moved so that the cutter drum will not skip over low section of roofing material to be removed nor dig too deeply into higher section of roofing material to be removed.

29 Claims, 13 Drawing Figures

APPARATUS FOR REMOVING ROOFING MATERIAL

BACKGROUND OF THE INVENTION

1. Field of the Invention

The present invention relates to apparatus for removing layers of material from a substrate, and more particularly to an apparatus which rolls over a roof and removes the roofing material as it moves over the roof.

2. Description of the Prior Art

The herebefore method known to me for removing roofing material from a roof is a manual operation performed by a crew of men using hand tools such as knives and scrapers. This manual method is laborous, time consuming and expensive.

SUMMARY OF THE INVENTION

The present invention provides an apparatus which rolls over a roof and removes the roof material from the roof substrate as it moves on the roof.

The present invention further provides an apparatus for removing roof material which is self propelled.

The present invention also provides an apparatus for removing roof material which is a powered roof material cutter device.

The present invention further provides an apparatus for removing roof material from a roof substrate which vacuums the shredded removed material away from apparatus for disposal.

The present invention still further provides an apparatus for removing roof material from a roof substrate of the class discribed which is operated by an individual.

More particularly, the present invention provides an apparatus for removing roofing material from a roof substrate comprising a framework having roof contact and control wheels and driven roof contact rollers attached thereto, a rotatable roof material planing drum attached to the framework located between the roof contact and control wheels and driven roof contact rollers with the axis of rotation of the planing drum parallel to the axis of rotation of the roof contact and control wheels and roof contact rollers, motor means operatively associated with the planing drum for rotatably driving roof material planing drum, and a suspension system interconnecting the roof contact and control wheels and roof contact rollers so that the rotatable roof material planing drum moves up and down in response to movement of the roof contact and control wheels up and down.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
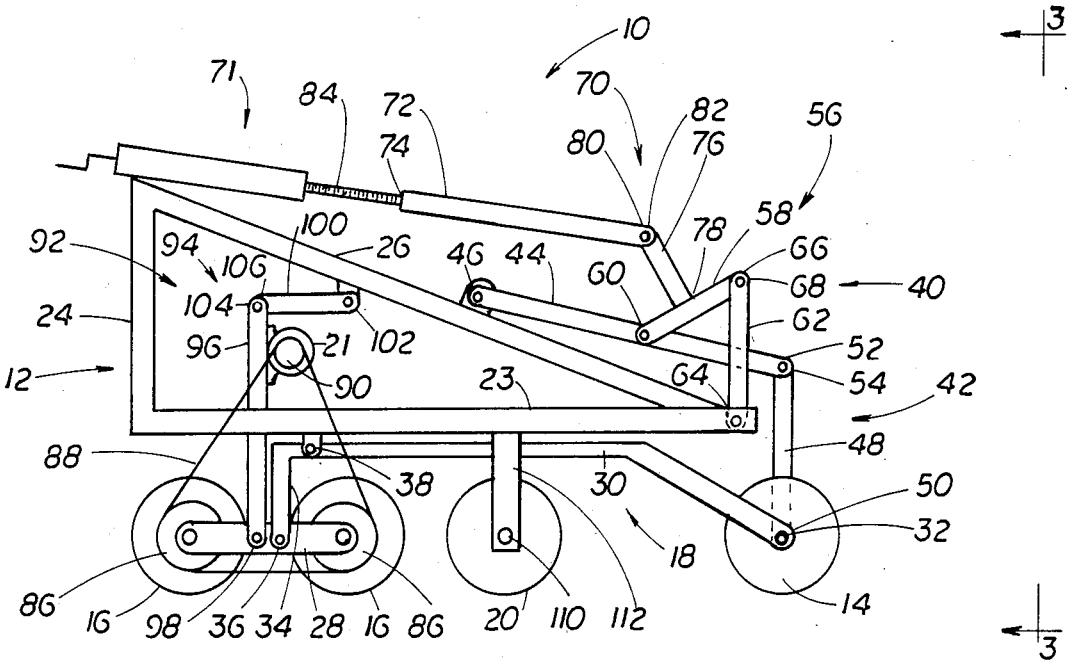
FIG. 1 is a right side view of the apparatus for removing roofing material of the present invention.
Figure 3:
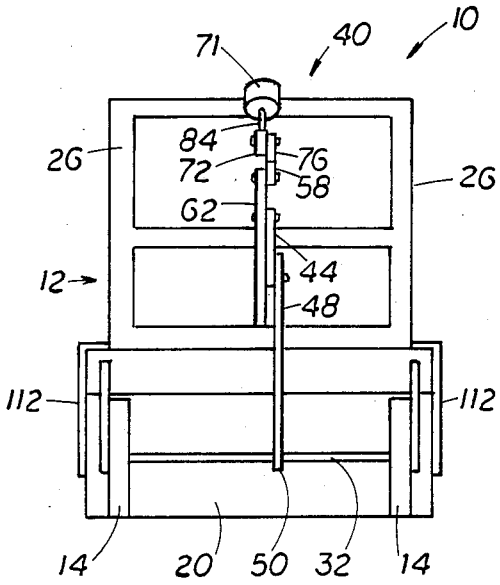
FIG. 3 is a front end view of the apparatus as seen in the direction of arrows 3—3 in FIG. 1.
Figure 4:
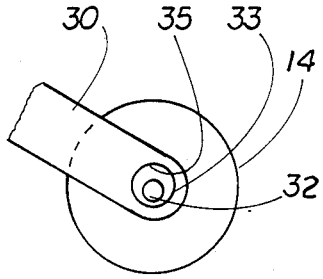
FIG. 4 is an enlarged view of one feature of the present invention.
Figure 5:
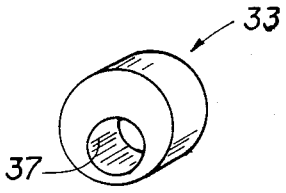
FIG. 5 is an enlarged view of a component of FIG. 4.
Figure 2:
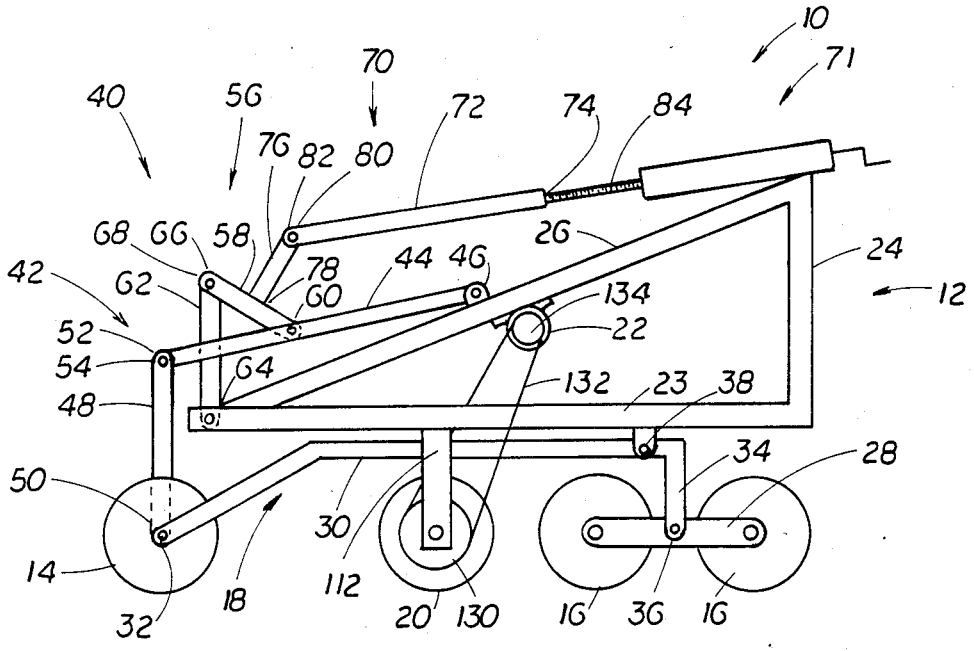
FIG. 2 is a left side view of the apparatus for removing roofing material of the present invention.

With reference to FIGS. 1–3, there is shown an apparatus, generally denoted as the numeral 10, for removing roofing material from a roof substrate.

The apparatus 10 comprises a framework 12, a pair of roof surface contacting and control wheels 14 at the front end of the framework 12, a tandem pair of roof surface contacting rollers 16 located at the rear end of the framework 12, and suspension system means, generally denoted as the numeral 18, interconnecting the roof surface contact and control wheels 14 and roof surface contacting rollers 16 to the framework 12. The axis of rotation of the roof surface contacting and control wheels 14 is transverse to the longitudinal axis of the framework 12, and the axis of rotation of the tandem pair of roof contacting rollers 16 is parallel to the axis of rotation of the roof surface contacting and control wheels 14. A roofing material planing drum 20 is suspended from and rotatably mounted to the framework 12 in the space between the front roof surface contacting and control wheels 14 and rear roof surface contacting rollers 16 with the axis of rotation of the roofing material planing drum 20 parallel to the axis of rotation of the tandem pair of roof surface contacting rollers 16.

The apparatus 10 also includes motor means 21 for rotatably driving the roof surface contacting rollers 16 and motor means 22 for rotatably driving the roofing material planing drum 20.

The framework 12 is illustrated as being formed of a pair of parallel spaced apart, horizontal side rails 23, a pair of parallel, elongated end bars 24 extending generally upwardly from the frame side rails 23, and a pair of parallel, elongated diagonal gusset bars 26 interconnecting each one of the frame end bars 24 to the frame side rails 230. Each one of the upwardly extending end bars 24 is affixed at its lower end to the rear end of a different one of the frame side rails 23. Each one of the elongated gusset bars 26 is affixed at one end to the upward end of a different one of the elongated end bars 24 and affixed at the other end to a different one of the frame side rails 23. The particular framework construction is incidental to the invention and, therefore, for the sake of brevity, the details of the construction of the framework 12 will not be described further.

The suspension system means 18 includes a pair of bogie bars 28 interconnecting a tandem pair of roof surface contacting rollers 16. The bogie bars 28 are located at opposite ends of the roof surface contacting rollers 16 and interconnect the axis of rotation of the roof surface contacting rollers 16 to form a bogie carriage. The suspension system means 18 further includes a pair of spaced apart parallel longitudinal bars 30 extending along the opposite sides of the framework 12 next to the horizontal rails 23 of the framework 12. Each of the longitudinal bars 30 of the suspension means 18 is attached at one of its ends to the axle 32 of the roof contacting and control wheels 14 and is pivotably attached at the other of its ends to a different one of the bogie bars 28 of the bogie carriage. As illustrated, the end of each longitudinal bar 30 pivotably attached to the bogie carriage has a downwardly projecting flange 34 which is pivotably affixed to a bogie bar 28 by a pivot joint 36. In addition, each of the longitudinal bars 30 is pivotably attached to the framework 12 by, for example, a pivot joint 38 located between the ends of the longitudinal bar 30, connecting the longitudinal bar 30 to the side rail 23 of the framework 12.

Referring to FIGS. 1–3 and 4–5, the axle 32 of the roof surface contacting and control wheels 14 is mounted at its opposite ends to the longitudinal bars 30 of the suspension system means 18 by an eccentric fitting 33. As can be best seen in FIGS. 4 and 5, each fitting 33 is formed of a cylindrical body which fits into an appropriate aperture 35 in the longitudinal bar 30. An axle receiving bore 37 is formed through the cylindrical body of the fitting 33 eccentric with the center line of the cylindrical fitting body. A set screw can be used to fix the fitting body in position in the aperture in the longitudinal bar 30.

The longitudinal bar 30 of the suspension system means 18 are selectively pivoted about the pivot joints 38 to adjust vertical position of the roof contacting and control wheels 14 relative to the side rails 23 of the framework by wheel adjusting means, generally denoted as the numeral 40. As illustrated, the wheel adjusting means 40 includes three interconnected two bar linkages. The first two bar linkage 42 is formed of a first bar 44 pivotably mounted at its distal end 46 to the framework 12 and a second bar 48 pivotably mounted to the axle 32 at its distal end 50 such that the axle 32 can pivot about the longitudinal centerline of the framework 12 at the distal end 50 of the second bar 48. The proximal end 52 of the first bar 44 is pivotably attached to the proximal end 54 of the second bar 48. The second two bar linkage 56 is formed of a first bar 58 pivotably mounted at its distal end 60 to the first bar 44 of the first two bar linkage 42 and a second bar 62 pivotably mounted at its distal end 64 to the framework 12. The proximal end 66 of the first bar 58 is pivotably attached to the proximal end 68 of the second bar 62. The third two bar linkage 70 is formed of a first bar 72 mounted at its distal end 74 to linkage moving means 71 and a second bar 76 fixedly attached at its distal end 78 to the first bar 58 of the second two bar linkage 56. The proximal end 80 of the first bar 72 is pivotably attached to the proximal end 82 of the second bar 76. The linkage moving means 71 is illustrated as a jackscrew device attached to the elongated bars 24 of the framework 12 and having its movable operating member 84 attached to the distal end 74 of the first bar 72 of the third two bar linkage 70. It is contemplated that the jackscrew device can be replaced with a hydraulic or pneumatic cylinder device having the operating rod attached to the distal end 72 of the first bar 72 of the third two bar linkage 70. It can be readily visualized that as the linkage moving means 71 causes the first bar 72 of the third two bar linkage 70 to move in one direction the coaction of the second and first two bar linkages will move the axle 32 upwardly toward the framework 12, and as the linkage moving means 71 causes the first bar 72 of the third two bar linkage 70 to move in the other direction the coaction of the second and first two bar linkages will move the axle 32 downwardly away from the framework 12. The axle 32 is free to move under the influence of the wheel adjusting means 40 due to the pivot joint 38 interconnecting the longitudinal bars 30 of the suspension system 18 to the side rails 23 of the framework 12.

As can be seen best in FIG. 1, roof surface contacting rollers 16 are driven by the motor 21 by a drive system comprised of driven sprockets 86 coaxially attached to each of the roof surface contacting rollers 16 and a drive chain 88 trained about a drive sprocket 90 on the motor output shaft, an idler sprocket 91, and the driven sprockets 86. The drive chain 88 is kept taut as the roof surface contact rollers 16 move with the elongated bars 24 of the suspension system means 18 about pivot joint 38 by chain tightening means 92. The chain tightening means 92 comprises a two bar linkage 94 having a first bar 96 with its distal end 98 pivotably attached to gusset bar 26 of the framework 12 and a second bar 100 with its distal end 102 pivotably attached to the bogie bars 28 of the bogie carriage. The proximal end 104 of the first bar 96 is pivotably attached to the proximal end 10 of the second bar 100. The motor means 21 for driving the roof contacting rollers 16 through the drive chain 88 is attached to the framework 12 and the idler sprocket 91 is attached to the second bar 100. As the roof surface contacting rollers 16 move upwardly toward the framework 12, the second bar 100 also moves upwardly and the idler sprocket 91 moves with the second bar 100. As the roof surface contacting rollers 16 move downwardly away from the framework 12, the second bar 100 also moves downwardly and the idler sprocket 91 moves with the second bar 100. Thus, the position of the idler sprocket 91 relative to the driven roof surface contacting rollers 16 and the drive sprocket 90 remains constant as the driven roof surface contacting rollers 16 move toward and away from the framework 12 on the longitudinal bars 30 of the suspension system 18 as the longitudinal bars 30 pivot about the pivot joint 38, when the position of the front roof contacting wheels 14 is adjusted relative to the framework 12.

With reference to FIGS. 1–3 and FIGS. 6–12, the roof material planing drum 20 comprises a plurality of spaced apart roof material shredding blades 108 and intervening spacers 120. The blades 108 are circular with the cutting surface formed on the periphery of the blades 108. The circular roof material cutting blades 108 are concentric with the rotational axis of the drum 20. As illustrated, the roof material shredding drum 20 has an axle 110 mounted at its opposite ends by jounal mounts 112 to the side rails 23 of the framework 12. The axle 110 is formed with two longitudinally extending grooves 114 spaced apart from each other 180 degrees about the circumference of the axle 110. Each of the roof material shredding blades 108 is formed with a central hole 116 for receiving the axle 110. When the circular blades 108 are fitting on the axle they are sandwiched between the spacers 120 and held against relative rotation about the axle 110 by the friction generated between the spacers 120 and blades 108. As can be best seen in FIG. 6, the plane of the circular blades 108 on the axle 110 are not perpendicular to the longitudinal axis of the axle 110, that is the plane of the blades 108 do not lay on the radius of the axle 110, but are oriented with the plane of the blades 108 at an angle to the radius of the axle 110. In addition, adjacent blades 108 are nonparallel with each other. Toward this objective, the blade spacers 120 are located between adjacent blades 108 on the axle 110. As can be best seen FIGS. 10, 11 and 12, each spacer 120 is in the form of a disc and has an axle receiving bore 122 and a groove engaging finger 124 projecting radially inwardly of the bore 122 from the circumference of the bore 122. The spacers 120 are fitted on the axle 110 with the finger 124 engaged in one or the other of the grooves 114 of the axle 110 to prevent movement of the spacers 120 about the circumference of the axle 110. The opposite blade oontact surfaces 126 and 128 of the disc spacer 120 are nonparallel to each other and nonparallel to the radius of the axle receiving bore 122 in the spacer 120. Toward this end, one blade contact surface 126 is inclined at an angle of, for example, 4 degrees to the radius of the axle receiving bore 122 and the other blade contact surface 128 is inclined at an angle of, for example, 4 degrees to the radius of the axle receiving bore 122. In addition, the slopes of the angled blade contact surface 126 and of the angled blade contact surface 128 are circumferentially off-set from each other about the axis of the axle receiving bore 122 by, for example, 90 degrees. Thus, all of the spacers can be identical in construction and still accomplish the above described orientation of the blades 108.

With reference to FIG. 2, the roof material planing drum 20 is rotatably driven by motor 22. Toward this end, a driven sprocket 130 is coaxially attached at one end of the planing drum 20 and a drive chain 132 is trained about a drive sprocket 134 on the output shaft of the motor 22 and about the driven sprocket 130.

Figure 13:
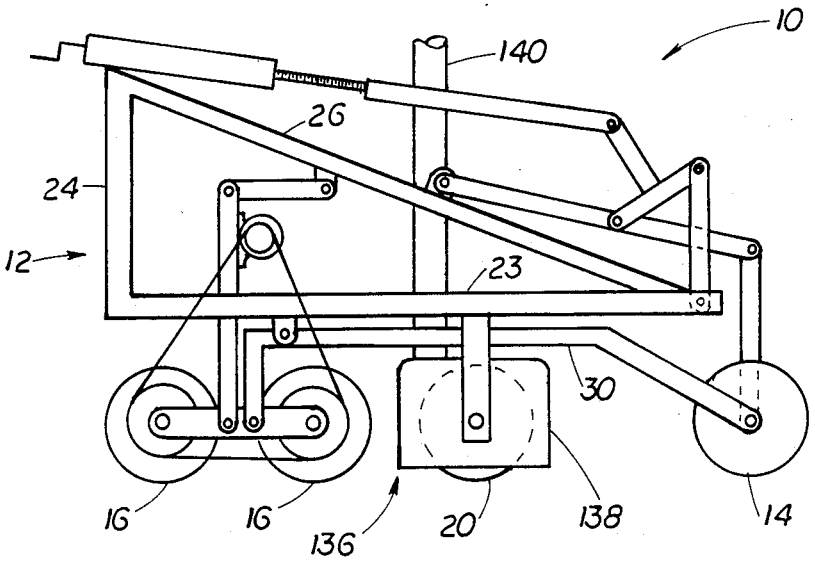
Figure 6:
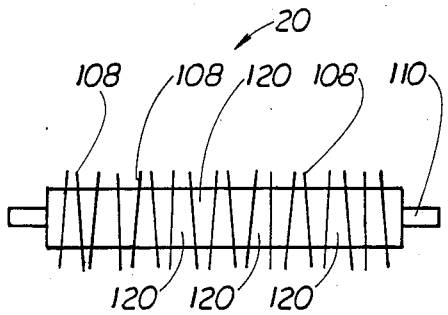
FIG. 6 is a side view of another feature of the present invention.
Figure 7:
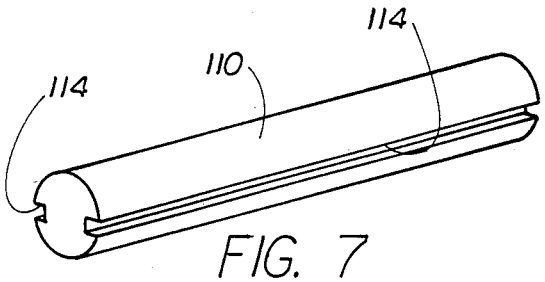
FIG. 7 is a prospective view of a component of FIG. 6.
Figure 8:
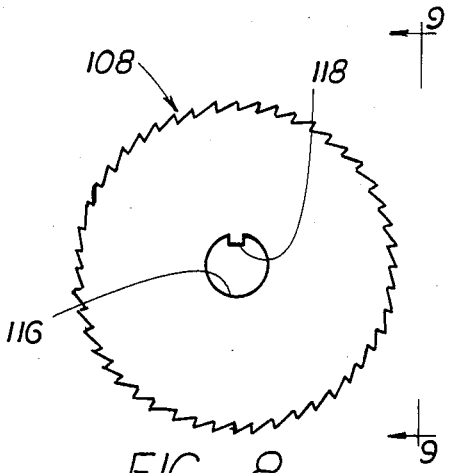
FIG. 8 is an enlarged side view of another component of FIG. 6.
Figure 9:
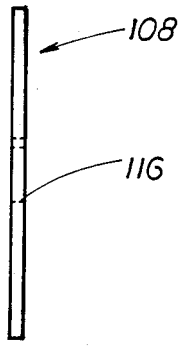
FIG. 9 is a view of the component of FIG. 8 as seen in the direction of arrows 9—9 in FIG. 8.
Figure 10:
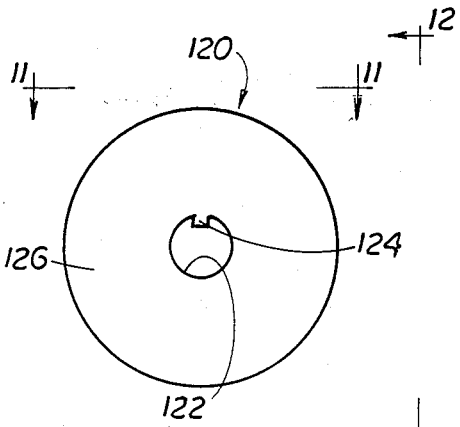
FIG. 10 is an enlarged side view of another component of FIG. 6.
Figure 11:
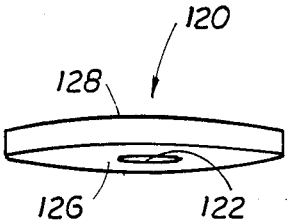
FIG. 11 is a view of the component of FIG. 10 as seen in the direction of arrows 11—11 in FIG. 10.
Figure 12:
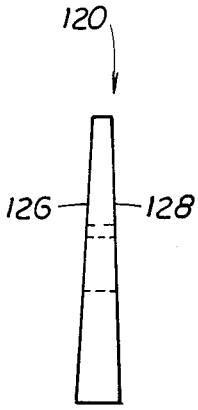
FIG. 12 is a view of the component of FIG. 10 as seen in the direction of arrows 12—12 in FIG. 10, and, FIG. 13 is a side view of an apparatus for removing roofing material of the present invention including a shredding roofing internal vacuum system.

Referring to FIG. 13, the apparatus also includes a shredding roofing material vaccum system 136 for conveying severed, shredded roof material away from the planing drum 20 for disposal. As shown, the vacuum system 136 includes a plenum 138 enclosing the top and sides of the roofing material planing drum 20. An exhaust stack communicates with the plenum 138 and is operatively associated with a vacuum generating device such as a fan (not shown).

In operation, the apparatus 10 is initially positioned on a roof with the roof surface contacting and control wheels 14 and roof surface contacting rollers 16 in contact with the roof surface. The front roof surface contacting and control wheels 14 are adjusted upwardly toward or downwardly relative to the framework 12 by manipulating the wheel adjusting means 40 so that the peripheral cutting surfaces of the blades 108 will contact the roof material. In addition, the inclination of the roofing material shredding drum 20 can be changed laterally of the apparatus 10 by rotating one or the other, or both of the wheel fittings 33 in the aperture 35 of the longitudinal bars 30 so that the cutting surface of all of the blades 108 along the length of the planing drum 20 will contact the roof material. When the apparatus 10 is in the initial position, the rollers 16, wheels 14 and cutting surface of all of the blades 108 are in contact with the roof material. The motor 21 driving the roof surface contacting rollers 16 is actuated to move the apparatus 10 along the roof surface and the motor 22 driving the roof material planing drum 20 is actuated to cut and shred the roofing material as the apparatus 10 moves along the roof surface. As the apparatus 10 moves, the front roof contact wheels 14 are raised, and because the roof contact wheels 14 remain in contact with the roof surface the framework 12 and planing drum 20 are lowered so that the planing drum 20 penetrates the roofing material to be removed. The front wheels 14 are raised, thus lowering the planing drum 20 until the desired depth of cut is obtained. The roof contacting rollers 16 behind the planing drum 20 ride on the roof substrate or cut path created by the planing drum 20 which cut path is at an elevation below that of the wheels 14. To compensate for the lower elevation of the rollers 16 relative to the wheels 14, the rollers 16 pivot about the pivot joint 36 connecting the bogie bar 28 to the longitudinal bars 30 without effecting the position of the wheels 14 and shredding drum 20 relative to the roofing material. Furthermore, the pivotal attachment of the axle 32 to the wheel adjusting means 40 provides for independent movement of the two longitudinal bars 30 of the suspension system so that the planing drum 20 will follow the contour of the roof surface laterally of the direction of movement of the apparatus and, therefore, laterally of the path cut by the planing drum. The vacuum system 136 is also actuated to convey shredded roofing material away from the shredding drum 20 for disposal.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed:

1. An apparatus for removing roofing material from a roof substrate comprising:

a framework;

a pair of spaced apart roof surface contacting and control wheels located proximate the front end of the framework and disposed to move vertically of each other;

at least one roof-surface contacting roller located proximate the rear end of the framework spaced from the roof surface contacting and control wheels longitudinally of the framework, the axis of rotation of the at least one roof contacting roller being parallel to the axis of rotation of the pair of roof contacting and control wheels;

suspension system means interconnecting the roof surface contacting and control wheels and the at least one roof surface contacting roller to the framework for allowing the roof surface contacting and control wheels to move in a vertical direction relative to and independently of the framework;

a roof material planing drum suspended from and rotatably mounted to the framework in the space between the roof surface contacting and control wheels and at least one roof surface contacting roller with the axis of rotation of the planing drum being substantially parallel to the axis of rotation of the roof surface contacting and control wheels and roof surface contacting roller; and, means for rotatably driving the roofing material planing drum.

2. The apparatus of claim 1 wherein the suspension system comprises means for selectively moving the front roof surface contacting and control wheels vertically toward and away from the framework.

3. The apparatus of claim 2, wherein the front roof surface contacting and control wheels are mounted to the suspension system moving means for pivotal movement about the longitudinal axis of the framework.

4. The apparatus of claim 1, wherein the suspension system comprises longitudinal bars spaced apart to either side of the framework and pivotably mounted to the framework, the front roof surface contacting and control wheels being rotatably connected to the longitudinal bars proximate the front end of the bars and the at least one roof surface contacting wheels being rotatably connected to the longitudinal bars proximate the rear end of the bars.

5. The apparatus of claim 3, wherein the suspension system further comprises means for selectively pivoting the longitudinal bars about the pivot mount to the framework for moving the front roof surface contacting wheels vertically toward and away from the framework.

6. The apparatus of claim 1, further comprising
means for rotatably driving the at least one roof surface contacting roller.

7. The apparatus of claim 6, wherein the means for driving the at least one roof contacting roller comprises:
a driven sprocket coaxially attached to the at least one roof surface contacting roller;
a driving sprocket operatively connected to the output shaft of a motor;
drive chain means trained about the driven sprocket and driving sprocket; and,
means for maintaining the drive chain taut as the at least one roof surface contact roller moves vertically toward and away from the framework with the suspension system means.

8. The apparatus of claim 7, wherein the means for maintaining the drive chain taut comprises:
a two bar linkage having the distal end of one bar pivotably connected to the framework, the distal end of the other bar pivotably connected to the suspension system proximate the at least one roof surface contacting roller, and the proximal ends of both bars being pivotably connected together;
an idler sprocket attached to one of the bars of the two bar linkage for movement therewith; and
the driving sprocket being interconnected to the framework; the drive chain being trained about the idler sprocket, driven sprocket and the driving sprocket.

9. The apparatus of claim 1, wherein the at least one roof surface contacting roller comprises:
a tandem pair of roof surface contacting rollers;
bogie bars interconnecting the tandem pair of roof surface contacting rollers forming a bogie carriage; and,
pivot mounting means pivotably connecting the bogie carriage to the suspension system means.

10. The apparatus of claim 1, further comprising:
each of the front roof surface contacting and control rollers is rotatably mounted on an axle; and,
a fitting attached to the suspension system means for mounting the roof surface wheel axle to the suspension means, the fitting being formed with an axle receiving bore eccentrically located to the centerline of the fitting, and the fitting being selectively rotatable about the centerline of the fitting.

11. The apparatus of claim 10, wherein the axle is pivotably mounted for movement about the longitudinal axis of the framework.

12. The apparatus of claim 1, wherein the roof material planing drum comprises a plurality of spaced apart, coaxially aligned circular cutting blades.

13. The apparatus of claim 12, wherein adjacent cutting blades are nonparallel with each other.

14. The apparatus of claim 13 wherein at least a portion of the circular cutting blades are nonparallel to the radius of the planing drum.

15. The apparatus of claim 13 wherein some of the cutting blades are parallel to others of the cutting blades.

16. The apparatus of claim 14 further comprising blade spacers located between adjacent cutting blades.

17. The apparatus of claim 16 wherein the opposite blade contact surfaces of each spacer are nonparallel to each other and nonparallel to the radius of the planing drum.

18. The apparatus of claim 17, wherein the slopes of the opposite contact surfaces of each spacer are circumferentially off-set from each other.

19. The apparatus of claim 12, wherein the roof material planing drum further comprises:
an axle having at least two longitudinally extending grooves spaced apart from each other circumferentially of the axle;
each of the circular cutting blades has a central hole for receiving the axle; and,
blade spacers located between adjacent cutting blades, each spacer has an axle receiving bore for receiving the axle, and a groove engaging finger projecting radially inwardly of the axle receiving bore for engaging in one or the other of the longitudinal grooves in the axle.

20. The apparatus of claim 19, wherein the opposite blade contact surfaces of each blade spacer are nonparallel to each other.

21. The apparatus of claim 20, wherein the opposite blade contact surfaces of each blade spacer are nonparallel to the radius of the axle receiving bore in the spacer.

22. The apparatus of claim 21, wherein the slopes of the opposite blade contact surfaces of each spacer are circumferentially off-set from each other about the axis of the axle receiving bore in the spacer.

23. The apparatus of claim 22, wherein the opposite blade contact surfaces of each spacer are angled to the radius of the axle receiving bore of the spacer by the same number of degrees.

24. The apparatus of claim 1 wherein the planing drum comprises:
a plurality of spaced apart, coaxially aligned circuit cutting blades wherein adjacent cutting blades are nonparallel to each other.

25. The planing drum of claim 24 wherein at least a portion of the circular cutting blades are nonparallel to the radius of the radius of the planing drum.

26. The planing drum of claim 24 wherein some of the cutting blades are parallel to other of the cutting blades.

27. The planing drum of claim 24 further comprising:
blade spacers located between adjacent cutting blades; and,
the opposite blade contacting surfaces of each spacer are nonparallel to each other and nonparallel to the radius of the planing drum.

28. The planing drum of claim 27, wherein the slopes of the opposite blade contact surfaces of each spacer are circumferentially off-set from each other.

29. The planing drum of claim 28, wherein the circumferential off-set of the opposite blade contacting surfaces of each spacer is 90 degrees.

* * * * *